United States Patent [19]

Wendt

[11] Patent Number: 4,513,549

[45] Date of Patent: Apr. 30, 1985

[54] PRE-MITERED DOORFRAME ASSEMBLY FOR PARTITION WALL CONSTRUCTION

[75] Inventor: Alan C. Wendt, Barrington, Ill.

[73] Assignee: United States Gypsum Company, Chicago, Ill.

[21] Appl. No.: 480,150

[22] Filed: Mar. 25, 1983

[51] Int. Cl.[3] ..... E06B 1/04

[52] U.S. Cl. ..... 52/211; 52/217

[58] Field of Search ..... 52/211, 213, 217; 49/504

[56] References Cited

U.S. PATENT DOCUMENTS

| | | | |
|---|---|---|---|
| 3,721,055 | 3/1973 | Jerchower | 49/504 |
| 4,223,494 | 9/1980 | Wendt | 52/211 |
| 4,281,480 | 8/1981 | Wendt | 52/213 |

*Primary Examiner*—James L. Ridgill, Jr.

*Attorney, Agent, or Firm*—Samuel Kurlandsky; Robert M. Didrick; Robert H. Robinson

[57] ABSTRACT

A doorframe assembly for partition wall construction comprising metal backer jamb members adapted for attachment to opposite sides of a door opening, jamb members snap-engaged with the metal backer jamb members, hinge plate means for supporting a door attached along a longitudinal recess portion of a jamb member at one side of the door opening, strike plate means adapted for receiving door locking means attached along a longitudinal recess of jamb member at the opposite side of the door opening, mortising trim of a material such as vinyl plastic or aluminum adhered along remaining open portions of the jamb members at both sides of the door opening, and two header clips one mounted at the upper end of each of the metal backer jamb members and arranged to permit the jamb members to be set to the exact dimension of a mitered header, thereby eliminating any manufacturing tolerances, and a mitered header member snap-engaged with said header clips.

14 Claims, 18 Drawing Figures

PRE-MITERED DOORFRAME ASSEMBLY FOR PARTITION WALL CONSTRUCTION

BACKGROUND OF THE INVENTION

1. Field of the Invention

The present invention relates to a doorframe assembly for a door opening in hollow wall partition construction, and more particularly refers to such a structure which facilitates setting the door jambs to the exact dimensions of the header, thereby eliminating any manufacturing tolerances.

2. Description of the Prior Art

Hollow partition wall construction featuring quick installation and field adaptability to particular construction requirements has become very desirable in recent years. Together with the hollow wall construction, framing for door openings must also allow for ease of installation with members that can be interchangeably used as particular needs arise in an overall office, residence, or factory partition wall system. It has become particularly important to provide framing members which can be interchangeably used and individually altered in the field.

Many prior art door frame techniques utilize extruded metal and vinyl elements to provide required quick installation. Typically, an exposed extruded jamb member provides slotting or notching for hinge members, securing plate members, door stops, trim plates, strike plates, and an array of necessary hardware elements for door framing. Unfortunately, many prior systems restrict attachment of hinge plates to only one jamb member and a strike plate to an opposing jamb member at the other side of the door opening. Also, some systems have large assortments of accessory parts that involve lengthy installation operations for their attachment. It would be desirable to provide door framing members which allow reversibility of jamb members with a limited number of accessory parts that would expedite installation and allow interchangeability of members having equally adaptable use at various door openings without limitation to a specific door opening location in a hollow wall partition construction.

It has also become a need of the construction industry to provide a door jamb member which permits the variable location of hinge plates without limitation to specifically notched portions. In attempting to solve this problem, past attempts have typically been limited to connection of hinge plates with metal members. With increased costs of providing decorative exposed metal jamb members the use of extruded vinyls has been explored. Problems, however, have arisen when trying to incorporate extruded vinyl members or thin wall aluminum members in that attachment to door opening sides necessitates the use of a sturdy metal backer of some sort. Complex shapes for metal backer jambs have thus been required in order to permit versatile location of hinge plate means. The hinge plate is then attached and followed by attachment of numerous extruded trim elements concealing unsightly and undecorated metal backer jambs. In many attempted solutions, a difficulty has arisen in providing the necessary thickness of metal backer members that feature surfaces usable with screw fasteners for affixation of hinge plate means to afford necessary strength for door support. Although hollow-core doors may be used to reduce weight and thus alleviate the requirement of extra strength, it would be highly desirable to have adaptability for use with a hollow-core or solid-core door in a hollow wall partition construction where needed. Conventional solid-core doors may range up to about 150 lbs. and sufficient strength of screw fastener attachment at hinge plate means is mandated. Efforts to provide this have been made wherein additional metal plates, shims, or plate means are inserted along a metal backer jamb behind hinge plate means to provide the necessary thicknesses for the conventional screw fastener attachment of hinge plate means involving the use of a heavier door.

At the side of a typical door opening where strike plate means coact with door locking means, a similar problem for allowing variable location of the strike plate has been confronted. In many recent attempts, the jamb at the strike side of the door opening requires a different shape and manner of installation than the jamb at the hinge side of the door opening. Moreover, pre-cut notches for attachment of a strike plate means necessarily limits the ability to provide universal support structures to be used at various door locations having different strike plate height requirements. In previous solutions to reversible jamb member framing, there has typically been provided a complex jamb member which allows for use at either side of the door opening, but requires additional material for extruding, or roll forming, cover plate members and engageable slots on jamb members to attain this feature.

In U.S. Pat. Nos. 4,223,494 and 4,281,480, by the present inventor, there are disclosed various improvements in the construction of doorframes. However, in regard to all the doors of the prior art it has been difficult to provide a structure wherein perfectly mitered header joints could be more readily obtained.

SUMMARY OF THE INVENTION

It is an object of the invention to provide a doorframe for hollow wall partition construction which permits field installing hinges and strike plates along a jamb member at any location for either right-hand or left-hand swinging doors.

It is additionally an object of the invention to provide a structure having plastic or metal trim strips which are field applied adjacent the hinges and above and below the strike plate members, providing relatively quick and easy field installation.

It is additionally an object of this invention to provide a snap-on engaging jamb member which snap-engages a metal backer jamb member.

It is a primary object of the invention to provide a structure wherein a header may be readily mounted for engaging the jambs at a good mitered joint.

The foregoing, and other objects, advantages, and characterizing features will become apparent from the following description of certain illustrative embodiments thereof, considered together with the accompanying drawings, wherein like reference numerals signify like elements throughout the various figures.

DESCRIPTION OF THE PREFERRED EMBODIMENT

Figure 1:
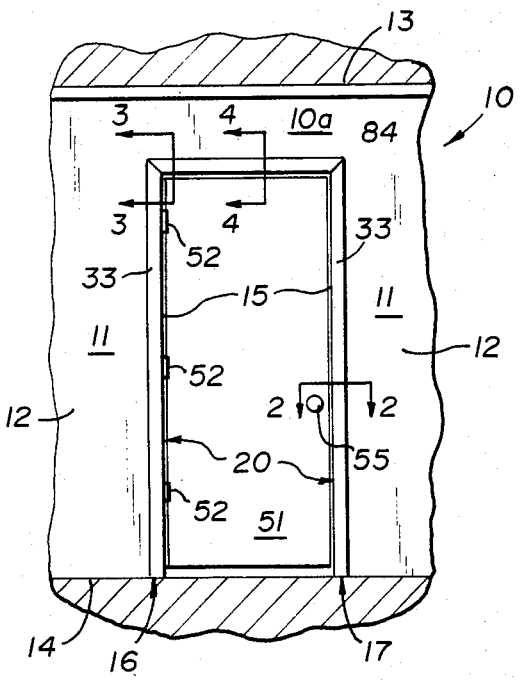
FIG. 1 is an elevational view of a hollow-wall partition having a framed door opening according to the invention with a door mounted therein.

Referring to FIG. 1, there is shown in elevational view a hollow-wall partition 10, of conventional design. The structure comprises two spaced-apart rows of panels 11, such as wallboard panels, with exposed wall face surfaces 12. The hollow-wall partition 10 extends from the ceiling 13 to floor 14. A door opening 15, having a vertical side 16 and an opposite vertical side 17 is provided. A portion 10*a* of the wall partition 10 extends above the door to the ceiling. A door member 51 is hung within door opening 15, being attached to a doorframe assembly 20 at side 16 by conventional hinges 52. At the opposite side 17, the door member 51 is provided with conventional locking means 55 which coacts with the doorframe assembly 20 at side 17 of door opening 15.

Figure 6:
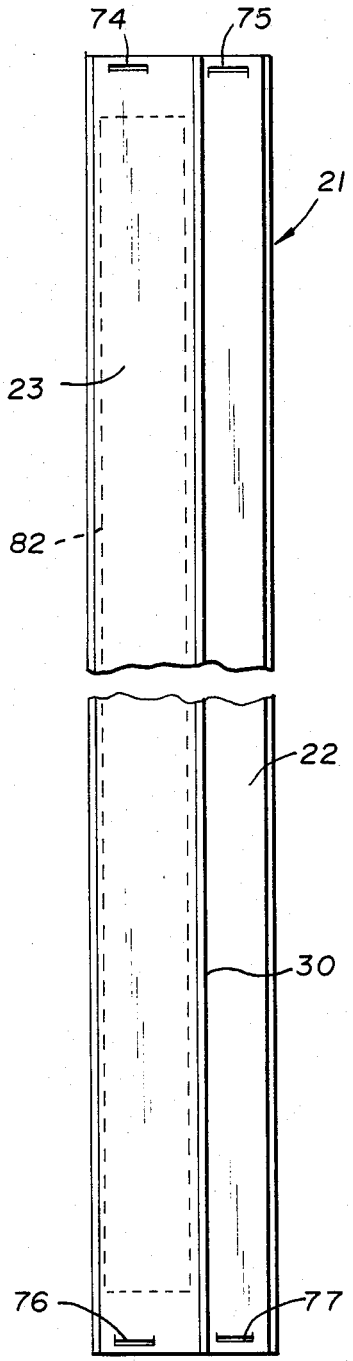
FIG. 6 is an elevational view of a metal backer jamb member.
Figure 7:
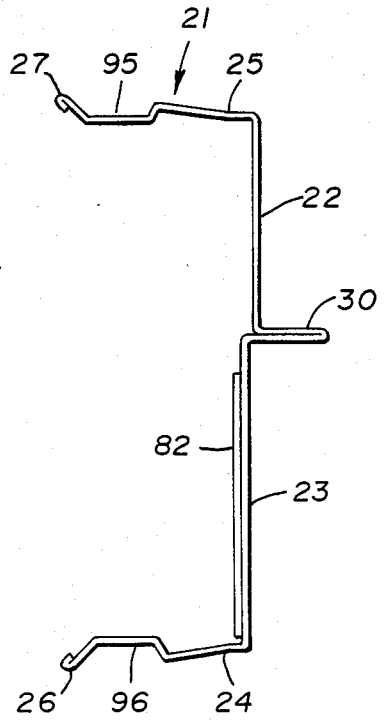
FIG. 7 is an end view of the structure of FIG. 6.

Referring to FIGS. 6 and 7, the backer jamb member 21 is shown, comprising a pair of webs 22 and 23 connected together by a fold comprising a spine or stop portion 30. The webs 22 and 23 are offset and are not coplanar. A reinforcing plate 82 may be affixed to the web 23 to provide hinge reinforcement when the backer jamb member is utilized to support a hinge jamb. The structure also comprises a pair of flanges 24 and 25, recessed portions 95 and 96 for providing screw head clearance, and out-turned lip portions 26 and 27. As shown in FIG. 6, slots 74, 75, 76 and 77 are provided to receive tabs 64, 65, 66 and 67 of a header clip 60 shown in FIGS. 8, 9 and 10. Slots 74–77 are provided at both ends of the backer jamb member 21 so that the member may be used as either a strike jamb or a hinge jamb, or may be used as either type on either side of the doorway.

Figure 8:
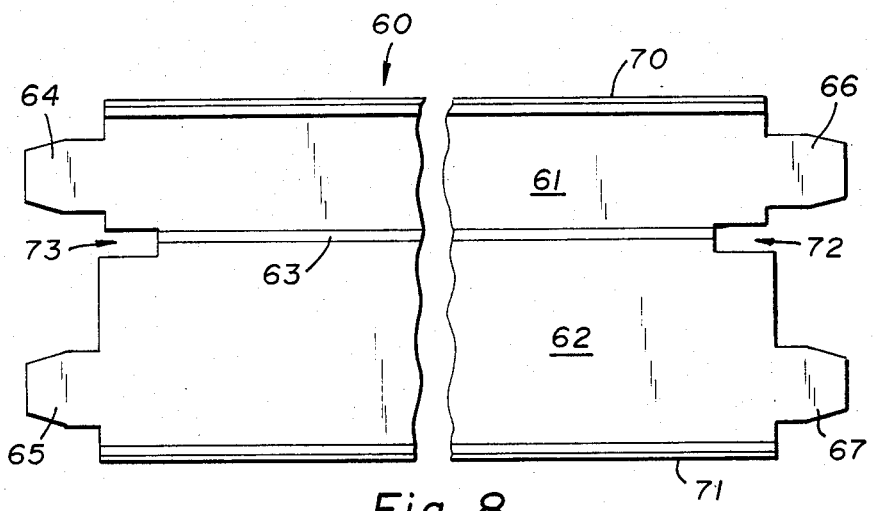
FIG. 8 is a plan view of a header clip according to the invention.
Figure 9:
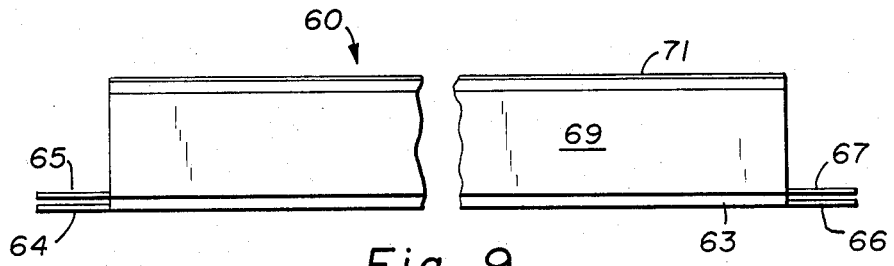
FIG. 9 is a side elevational view of the header clip shown in FIG. 8.
Figure 10:
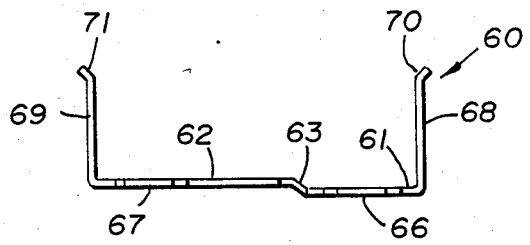
FIG. 10 is an end view of the header clip shown in FIGS. 8 and 9.

Referring to FIGS. 8, 9 and 10, a header clip 60 is shown, which comprises the principal part of the invention. The structure comprises webs 61 and 62 which are slightly offset at an offset fold 63. The header clip 60 is provided with tabs 64, 65, 66 and 67 at its ends. Although only the tabs at one end are utilized at a time, tabs may be provided at both ends so that each header clip 60 may be used at either side of the doorway as either the strike jamb side or the hinge jamb side. The clip 60 has flanges 68 and 69 provided at the end of the webs 61 and 62, respectively, with out-turned lips 70 and 71, respectively. Additionally slots 72 and 73 are provided to receive the spines 30.

The use of a pair of header clips instead of a conventional unitary header support provides several advantages. First, there is a savings in material cost. Further, when using unitary or integral header supports, it has always been difficult to fit the header to provide a close fitting mitered joint between the header ends and the jamb member ends. It was also necessary to hold the dimensions of the structures to close tolerances in order to provide a reasonably good fit. With the present structure, the header clips are directly affixed to the ends of the backer jamb members by means of the tabs 64–67 and slots 74–77. The header member 84, shown in FIGS. 3 and 4 may then be snapped onto the header clips and the strike backer jamb member adjusted in place until a good fit is obtained. The jambs may then be snapped onto the backer jamb members and provide an excellent mitered fit.

Figure 11:
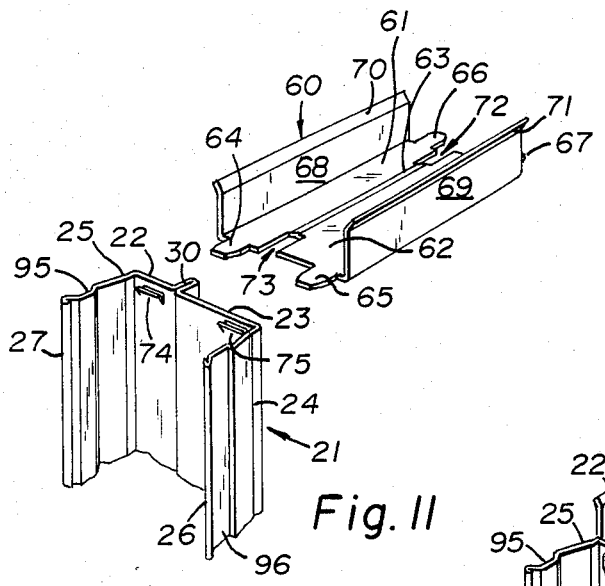
FIG. 11 is a perspective view showing a header clip about to be engaged with the end of a backer jamb member.
Figure 12:
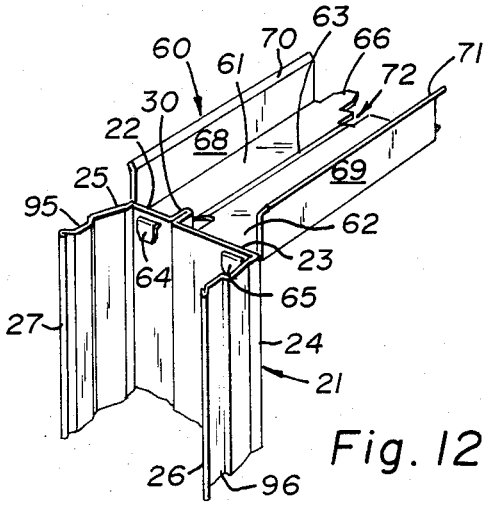
FIG. 12 is a perspective view showing the end of a header clip engaged with the end of a backer jamb member and the tabs of the header clip bent over.
Figure 13:
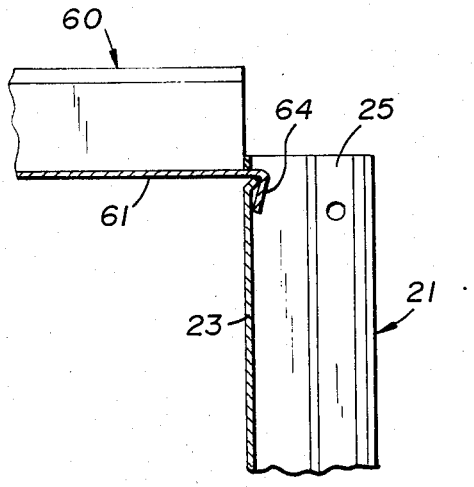
FIG. 13 is an end view partly in cross-section of a backer jamb member showing the tab of a header clip engaged in a slot therein.

Referring to FIGS. 11, 12 and 13, the method of connecting the header clip 60 to either of the backer jamb members is shown. In FIG. 11 the members are shown in position ready to be connected together. The members are brought together with the tabs 64 and 65 in position to be inserted into the slots 74 and 75, respectively, with the stop portion or spine 30 in position to be inserted into the slot 73. FIG. 12 illustrates the members after the tabs 64 and 65 have been inserted and bent over. As a result the two structures are strongly affixed together. FIG. 13 shows the arrangement from a different view.

Figure 2:
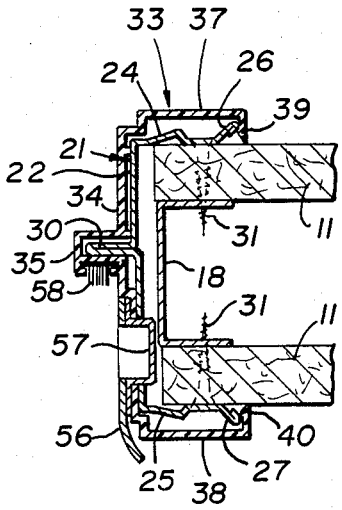
FIG. 2 is a cross-sectional view taken at the line 2—2 of 1, looking in the direction of the arrows.

Referring to FIG. 2, the strike jamb assembly of the invention is shown at side 17 of door opening 15 which may be provided with door bolts, latches, and the like.

Stud member 18 is positioned adjacent side 17 and spaced between panels 11 at their ends. Panels 11 have wall face surfaces 12 which are engaged by screw fasteners 31 securing free legs or flanges 24 and 25 of the metal backer jamb member 21 thereto. Also shown in FIG. 2 is a vinyl or aluminum jamb member 33 snap-engageable with metal backer jamb member 21. Being reversible, the jamb members 33 may be snap-engaged interchangeably at either side 16 or side 17.

The backer jamb member 21 structure further comprises web members 22 and 23 having a spine or stop member 30, flanges 24 and 25, and turned-out lips 26 and 27. The backer jamb members may be formed of 22-gauge galvanized steel (0.030 inch).

The jamb member 33 structure comprises a web or body portion 34, flanges 37 and 38, and turned-in lips 39 and 40 having hooks 89 and 90 at the edges thereof. The jamb members 33 are snap-mounted over the backer jamb member 21. Since they are reversible, the jamb members may be snap-engaged interchangeably at either side 16 or 17, serving either as strike jamb members or as hinge jamb members. Also shown are a strike plate 56, a latch socket or dust box 57 and a mute or bumper 58 formed of nylon pile.

Figure 3:
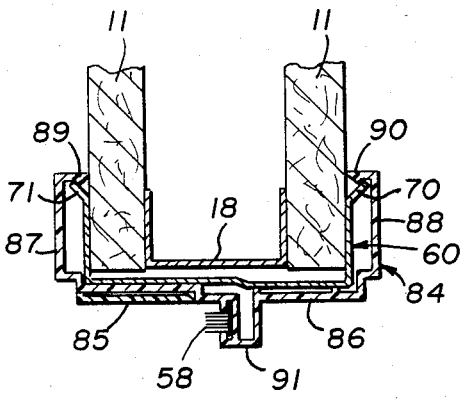
FIG. 3 is a cross-sectional view taken at the line 3—3 of FIG. 1, looking in the direction of the arrows.
Figure 4:
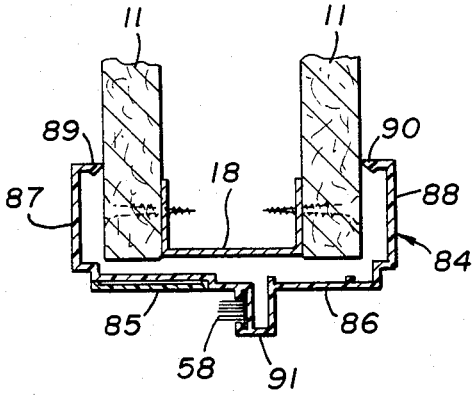
FIG. 4 is a cross-sectional view taken at the line 4—4 of FIG. 1, looking in the direction of the arrows.

Referring to FIGS. 3 and 4, the header structure according to the invention is shown. In both figures there are shown wall panels 11 having a lintel comprised of a metal stud 18 mounted between the wall panels. FIG. 3 also illustrates the header clip 60 mounted over the wall structure. A header member 84 is shown snap-mounted over the header clip 60. The header member 84 is comprised of a pair of webs 85 and 86, flanges 87 and 88 having hooks 89 and 90 engaging out-turned lips 70 and 71 of the header clip 60. The header member 84 also has a doorstop portion 91 having a mute backing 58. The structure shown in FIG. 4 does not have the header clip 60 shown as it is taken at a position intermediate the two clips.

Figure 5:
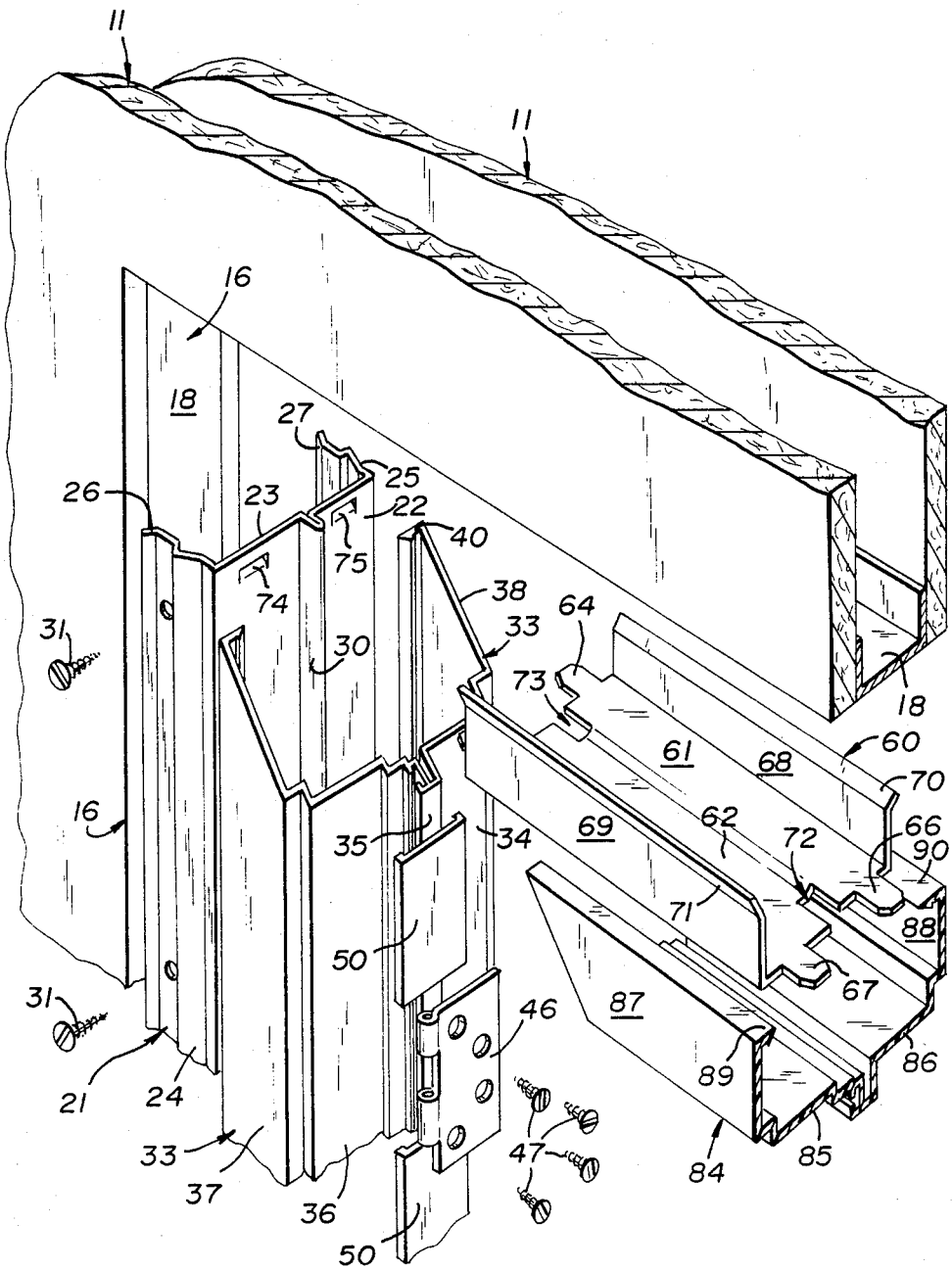
FIG. 5 is an exploded partial perspective view of one corner of the frame structure.

Referring to FIG. 5, the hinge side of the door opening 15 is shown, comprising studs 18 having a conventional channel shape used in hollow-wall construction and spaced adjacent side 16 at the ends of the panels 11, providing wall and doorframe support adjacent the door opening 15. In a preferred embodiment, the stud 18 comprises a metal channel, but other materials may be used such as wood. Positioned to extend along side 16 is a metal backer jamb member 21. Snap-engaged to the metal backer jamb member 21 is a jamb member 33 which may be formed of a vinyl plastic material or of aluminum. The jamb member 33 conceals and envelopes the metal backer jamb member 21 by covering it to exclude it from view. Since the jamb member 33 is provided for the full length of the door opening 15, it provides an esthetically pleasing jamb surface whether the metal backer jamb member 21 extends for the full height or less than full height. The hinge plate means 46 is attached to the jamb member 33 by screws and is flanked above and below by mortising trim 50 in accordance with the invention.

Metal backer jamb member 21 is provided with a generally U-shape having a web portion 22 and flanges 24 and 25 extending therefrom to form the generally U-shape. Flanges 24 and 25 respectively terminate in outwardly directed lip portions 26 and 27 providing snap-engageable means. Screw fasteners 31 attach free legs 24 and 25 to wall face surfaces 12. Screw fasteners 31 are preferably provided as being self-drilling screws well known to the construction industry. A characterizing feature of metal backer jamb member 21 is an additional affixed plate 82, shown in FIG. 7, provided along a portion of web portion 23 and extending almost the full length of metal backer jamb member 21. The thicker plate attachment surface is desirable in order to provide a screw-attachable surface for screw-attaching hinge plates which support door member 51. The channel-shaped stud member 18 at side 16 opens inwardly and has the web of the channel at the edges of the panels 11, abutting the back of web portion 22. In an alternate preferred embodiment of the invention, stud member 18 opens outwardly. A generally centrally located in-turned leg portion 30 runs adjacent thicker web portion 23 and extends for the full length of metal backer jamb member 21. In-turned leg or stop portion 30 is provided to project inward into the doorstop portion 35 of snap-engaged vinyl jamb member 33 for rigidity along the length of doorstop portion 35.

Further as shown in FIG. 5, jamb member 33 has a generally U-shape, and is preferably formed of an extruded rigid vinyl plastic material or thin walled aluminum well suited to door-framing construction. Jamb member 33 has body portion 34 with doorstop portion 35 being upraised from body portion 34 and having a hollow configuration wherein in-turned leg portion 30 projects for additional rigidity. Running the length of body portion 34, as shown for the strike jamb structure, there is provided a longitudinal recess 36 positionally corresponding with thicker web portion 23. Longitudinal recess 36 provides an attachable surface for hinge plate means 46, positioned thereon. At opposite edges of body portion 34 are flanges 37 and 38 projecting therefrom to form the generally U-shape. Flanges 37 and 38 terminate in in-turned nib portions 39 and 40. The length of flanges 37 and 38 extend to register with lip portions 26 and 27 of flanges 24 and 25 permitting snap-engagement between the in-turned nib portions 39 and 40 with these lip portions 26 and 27. Thereby, jamb member 33, as described, conceals and is supportingly engaged to, metal backer jamb member 21. The conventional hinge plate means 46 reside along longitudinal recess 36 for connective attachment with conventional hinge means 52 affixed to door member 51. Hinge plate means 46 is fastened by means of conventional fasteners such as self-drilling screws 47 which penetrate jamb member 33 and screw-attached to thicker web portion 23 of metal backer jamb member 21. Typically, two to four hinge connections support door members in hollow-wall partition construction, but it is within the purview of this invention to be adaptable for use with any normally reasonable number of hinges. Hinge plate means 46, in the preferred embodiment shown, is provided at three locations along longitudinal recess portion 36 in correspondence with, and attached to, said three hinge means 52 which are affixed along an edge of door member 51.

Flanking hinge plate means 46 is mortising vinyl or aluminum trim 50 having a thickness substantially the same as hinge plate means 46. A generally planar finished surface is thereby provided. Mortising trim may be quickly field-cut for ease of installation and size adaptability during erection of doorframe 20. The mortising trim 50 is adhered to longitudinal recess 36 by adhesive material. Well-known adhesive materials may be used to facilitate this attachment such as synthetic resins or rubber. A feature of longitudinal recess 36 is the ability of an installer to vary locations of hinge plate means 46 therealong. The use of mortising trim 50 above and below hinge plate means 46 complements such hinge installation because it may be readily field cut to accommodate spacing requirements above and below hinge plate means 46 however located.

Figure 14:
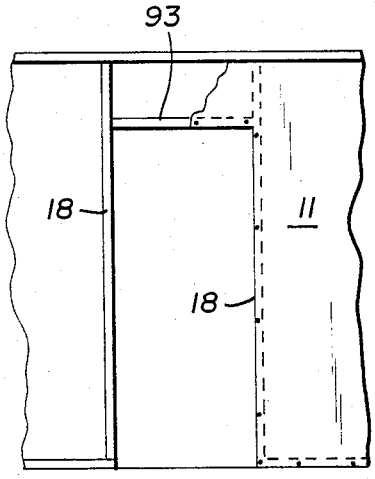
FIG. 14 is an elevational view of a door opening showing the basic frame structure.
Figure 15:
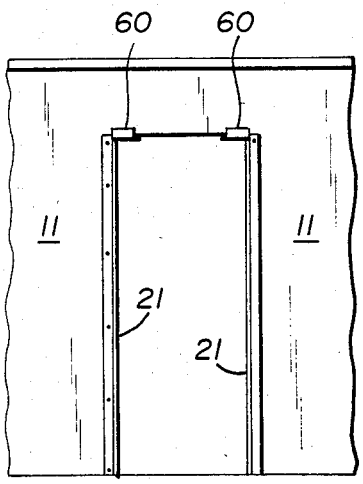
FIG. 15 is an elevational view of the structure shown in FIG. 14, additionally having backer jamb members and header clips mounted thereon.
Figure 16:
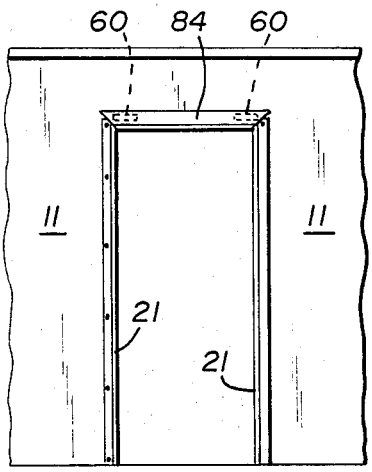
FIG. 16 is an elevational view of the doorframe structure showing a header member snapped over the header clips.

In erecting the present doorframe, a frame formed of studs 18 including a lintel 93 is first formed as shown in FIG. 14. A header clip 60 is then mounted at the end of each backer joist member 21 by inserting the tabs 64 and 65 through the slots 75 and 74 and bending over the tabs, as shown in FIGS. 11 and 12, thereby forming a structure as shown in FIG. 15. Both steel jambs are placed in position, plumbed, and the hinge jamb is screw-attached on the door side only, and the structure checked for jamb straightness. As shown in FIG. 16 the header is snapped over the header clips. The header is squared to the backer hinge jamb member by moving the strike jamb. The strike jamb is pushed tight against the header and attached at the top by a fastener.

Figure 17:
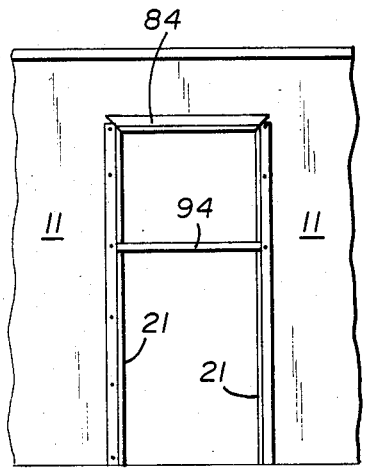
FIG. 17 is an elevational view of the doorframe showing the header and a template mounted in place.
Figure 18:
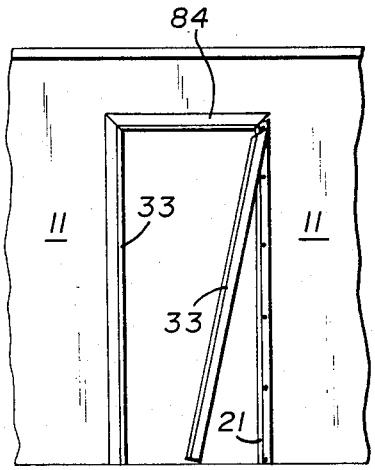
FIG. 18 is an elevational view of the doorframe showing the one jamb member mounted in place and the other jamb member being fitted in place.

Next, as shown in FIG. 17, completion is accomplished by screw-attaching both jambs using a template 94 for proper spacing. The jamb member corners are then cut to length and are snapped over the steel backer jamb members, as shown in FIG. 18. The door is then hung and the lockset installed and the mortise trim applied, to form the structure shown in FIG. 1.

In the construction of conventional doorframe assemblies, such as shown in the patents cited above, and particularly where a portion of the wall extends above the doorway, it is almost impossible to provide tight miter joints at the corners. In such prior structures the components which must be manufactured are the metal backer members, whether they be for jambs or for a header, and having a vinyl or aluminum cover snapped over the backer members. It has been found to be virtually impossible to provide dimensions which have sufficiently close tolerances. Where a continuous header spans the opening which has, for example, a 36" dimension, the actual dimension may be under 36" or over 36". Similarly, when the jamb covers are miter-cut, they also are nominally 36" and would have their own tolerances. Consequently, if the backer members are on the plus side of tolerances and the covers are on the minus side of tolerances, one ends up with unsightly gaps at the mitered corners of the doorframe. By avoiding a continuous member spanning the opening, and utilizing separate header clips at each corner, it permits the workman to set the strike jamb to the actual dimension of the jamb or header covers, so that problems due to manufacturing tolerances are eliminated.

Further, with regards to the economics, it is less expensive to provide header clips instead of complete headers, since there is less bulk, and less manufacturing tolerances to worry about, since the two header clips can readily accommodate any door size opening. Consequently one need only to set up and cut the header cover to whatever the finished frame dimensions should be instead of having to cut a backer member and subsequently, additionally provide a header cover cut to those dimensions.

Although the invention has been described in connection with a specific embodiment thereof, it is evident that many alternatives, modifications and variations will be apparent to those skilled in the art in light of the foregoing description and drawings. Accordingly, it is intended to embrace all such alternatives, modifications, and variations as felt within the spirit and broad scope of the appended claims.

Invention is claimed as follows:

1. A doorframe assembly adapted to be mounted in a door opening in a wall and to support a door, comprising in combination:

A. a pair of metal backer jamb members adapted to be mounted in said door opening, one for supporting a hinge jamb and the other for supporting a strike jamb, adapted for attachment to opposite sides of said door opening, said backer jamb members being of generally U-shaped structure and comprising a web portion having a pair of flanges defining a generally U-shaped structure, said flanges being adapted for fastening at opposite wall surfaces adjacent to said door opening, B. a pair of header clips comprising a web portion having a pair of flanges forming a generally U-shaped structure, C. means for affixing each header clip at one end to the upper end of one of said backer jamb members, D. generally U-shaped jamb members adapted to be snap-mounted one on each of said backer jamb members, and E. a generally U-shaped header member adapted to be snap-mounted on said header clips, the upper ends of said jamb members and both ends of said header members having complementary mitered ends to form a close mitered fit.

2. A doorframe assembly according to claim 1, wherein the flanges of said backer jamb members are provided with out-turned lips and the flanges of said U-shaped jamb members are provided with complementary hooks for engaging said out-turned lips.

3. A doorframe assembly according to claim 1, wherein said backer jamb members have supporting spines and said jamb members have a channel adapted to received said supporting spines and serving as a stop for a door mounted on said doorframe assembly.

4. A doorframe assembly according to claim 1, wherein said hinge backing jamb member has a plate affixed to a portion of the web thereof for reinforcing the hinge mounting.

5. A doorframe assembly according to claim 1, wherein said header clip has a pair of web portions which are offset with respect to each other.

6. A doorframe assembly according to claim 1, wherein said means of affixing each header clip to the upper end of a backer jamb member comprises tabs provided at at least one end of said header clip and complementary slots provided at the upper end of said backer jamb member, said tabs being adapted to be inserted in said slots and bent over to secure said clip to said backer jamb member.

7. A doorframe assembly according to claim 6, wherein tabs are provided at both ends of said header clip to enable said clip to be used either on the right side or on the left side of said doorway.

8. In combination:

A. a hollow wall partition construction having two spaced-apart rows of wall panels with opposite wall face surfaces, B. a door opening in said hollow wall partition construction having vertical stud members positioned adjacent opposite sides of the door opening, C. a pair of metal backer jamb members mounted in said door opening, one supporting a hinge jamb and the other supporting a strike jamb, and being attached to opposite sides of said door opening, said backer jamb members being of generally U-shaped structure and comprising a web portion having a pair of flanges defining a generally U-shaped structure, said flanges being fastened at opposite wall surfaces adjacent to said door opening, D. a pair of header clips comprising a web portion having a pair of flanges forming a generally U-shaped structure, E. means affixing each header clip at one end to the upper end of one of said backer jamb members, F. generally U-shaped jamb members snap-mounted one on each of said backer jamb members, and G. a generally U-shaped header member snap-mounted on said header clips, the upper ends of said jamb members and both ends of said header members having complementary mitered ends to form a close mitered fit.

9. A combination assembly according to claim 8, wherein the flanges of said backer jamb members are provided with out-turned lips and the flanges of said U-shaped jamb members are provided with complementary hooks engaging said out-turned lips.

10. A combination according to claim 8, wherein said backer jamb members have supporting spines and said jamb members have a channel receiving said supporting spines and serving as a stop for a door mounted on said doorframe assembly.

11. A doorframe assembly according to claim 8, wherein said hinge backing jamb member has a plate affixed to a portion of the web thereof for reinforcing the hinge mounting.

12. A doorframe assembly according to claim 8, wherein said header clip has a pair of web portions which are offset with respect to each other.

13. A combination according to claim 8, wherein said means of affixing each header clip to the upper end of a backer jamb member comprises tabs provided at at least one end of said header clip and complementary slots provided at the upper end of said backer jamb member, said tabs being inserted in said slots and bent over to secure said clip to said backer jamb member.

14. A combination assembly according to claim 13, wherein tabs are provided at both ends of said header clips to enable said clips to be used either on the right side or on the left side of said doorway.

* * * * *